US005419450A

United States Patent [19]

Guglielmelli et al.

[11] Patent Number: 5,419,450

[45] Date of Patent: May 30, 1995

[54] STORAGE CANISTER FOR PROTECTIVE BREATHING EQUIPMENT

[75] Inventors: Joseph Guglielmelli, Howell; Charles M. Huck, Gladstone, both of N.J.; James V. Zappa, Williamsville, N.Y.

[73] Assignee: Figgie International Inc., Willoughby, Ohio

[21] Appl. No.: 121,532

[22] Filed: Sep. 16, 1993

[51] Int. Cl.[6] ..... B65D 51/00

[52] U.S. Cl. ..... 220/256; 220/212.5; 128/200.24; 128/201.25; 128/205.27

[58] Field of Search ..... 220/212.5, 256, 258, 220/260, 266, 270, 318, 367, 256, 259; 128/200.24, 201.25, 205.27

[56] References Cited

U.S. PATENT DOCUMENTS

| | | | |
|---|---|---|---|
| 1,976,739 | 10/1934 | McBride et al. | 220/256 |
| 2,332,345 | 10/1943 | Moll | 220/55 |
| 3,072,285 | 1/1963 | Aileo | 220/44 |
| 3,906,945 | 9/1975 | Netteland et al. | 128/191 |
| 3,943,987 | 3/1976 | Rossi | 150/5 |
| 4,005,708 | 2/1977 | Netteland et al. | 128/142 |
| 4,039,620 | 8/1977 | Netteland et al. | 423/230 |
| 4,169,568 | 10/1979 | Drew et al. | 244/148 |
| 4,358,025 | 11/1982 | Urion | 220/258 |
| 4,465,189 | 8/1984 | Molzan | 206/524 |
| 4,551,311 | 11/1985 | Lorenz | 220/256 X |
| 4,690,296 | 9/1987 | Elliott | 220/256 X |
| 4,724,979 | 2/1988 | Cleevely et al. | 220/270 X |
| 4,726,365 | 2/1988 | Jablonski | 128/202 |
| 4,753,377 | 6/1988 | Poluhowich | 224/163 |
| 4,832,198 | 5/1989 | Alikhan | 206/438 |
| 4,990,345 | 2/1991 | Webb | 220/256 X |
| 5,005,700 | 4/1991 | Rohling et al. | 206/459 |

*Primary Examiner*—Steven M. Pollard

*Attorney, Agent, or Firm*—Hodgson, Russ, Andrews, Woods & Goodyear

[57] ABSTRACT

A storage canister apparatus (10,110) particularly useful for housing a Protective Breathing Equipment (PBE) device therein, is described. A first embodiment of the storage canister comprises a container (12) provided with a removable closure means in a vacuum sealed relationship therewith to prolong the useful life of the PBE device housed therein. The closure means is secured to the container by a gasket seal (44) such that a pulling force on a handle (64) causes the closure means to move with respect to the container to release a plug (44) provided in an inner cover (16) to thereby break the vacuum seal to access the PBE device. A second embodiment comprises a "peel top" closure means that is peeled from the container in response to a pulling force applied to a handle (156) to release the vacuum sealed relationship between a container (114) and the closure means to thereby access the PBE device housed therein. Both embodiments of the storage canister provide for instant access to the PBE device which is important when the breathing equipment must be donned quickly in an emergency situation.

20 Claims, 5 Drawing Sheets

STORAGE CANISTER FOR PROTECTIVE BREATHING EQUIPMENT

BACKGROUND OF THE INVENTION

1. Field of the Invention

The present invention relates to a storage container, and in particular, a vacuum sealed canister apparatus that preferably provides for holding a Protective Breathing Equipment (PBE) device, 2. Prior Art Conventionally, a PBE device for airplane crews is packaged in a clear, partially evacuated bag openable by a tear strip. The bag is placed in a fire-proof, hard shell container closed by a lid, which must first be opened to access the bag holding the PBE device. Such a system is shown in U.S. Pat. No. 5,005,700 to Rohling et al. which comprises a double-shell housing containing an evacuated, flexible envelope or pouch holding a respirator as the PBE device. The problem is that fast donning time for the PBE device is important. The use of a flexible pouch provided inside a container necessitates opening two packages to access the PBE device.

Another packaging device is shown in U.S. Pat. No. 4,726,365 to Jablonski which discloses a rip-open, thin-section pouch holding a disposable air filtration mask. The pouch includes a transparent or semi-transparent front panel through which the mask is visible and a pull tab that enables the pouch to be opened by tearing along a seam. This device does not have a hard-shell container and is not particularly adapted for use in low pressure high altitude environments. Also, the pouch is susceptible to inadvertent tearing, puncturing and like damage.

A hard-shell storage container is shown in U.S. Pat. No. 4,465,189 to Molzan which describes a waterproof container having an upper body portion sealed to a lower body portion. The upper body portion is provided with a pressure relief valve that allows air to escape from the interior of the container under high-altitude conditions. A screw type vacuum relief valve eliminates the vacuum inside the container after the container has been collapsed under the force of external pressure to facilitate entry into the container. The problem is that the screw-type relief valve is unacceptably time consuming when fast donning time of the PBE is required.

There is thus a need for a canister for holding a PBE device that prevents unwanted and inadvertent breaching of the canister integrity while providing instant access to the contents held therein. This requires that the canister have a lid that is quickly and easily removed from the container portion of the canister while being protected from inadvertent breaching when the canister is not intended to be opened.

SUMMARY OF THE INVENTION

The canister device of the present invention comprises a hard shell container having an open end that is closed by a removal closure means. The closure means can be quickly removed from a container portion of the canister apparatus to provide for fast donning time of the PBE device held therein. Several embodiments of the closure means are described including a removable "gasket seal" closure assembly sealed to the container by a gasket that allows the closure assembly to be reused. The closure assembly comprises an outer cover that is provided with a pair of hinges. The first hinge releases a handle so that pulling force on the handle moves the outer cover away from the container. This cause the second hinge to actuate and pivot a connected clamp plate away from an inner cover to move a vacuum release plug out of a vent opening in the inner cover. When the vacuum is released, further pulling movement on the outer cover causes the outer cover to completely separate from the container so that the inner cover can then separate from a gasket sealed to the container to thereby expose the breathing equipment contained therein. This canister can be reused by assembling the gasket, inner cover, clamp plate, vacuum release plug and outer cover on the container and pulling a vacuum on the system.

Another embodiment of the closure means of the present invention comprises a lid preferably made of an aluminum sheet having a polyester laminate heat-sealed to a web provided around the open end of the container. The lid sheet is protected from being inadvertently breached through puncture, tearing, cutting and like damage by a hard shell cover that is snap fitted on the container around the web and over the lid. A tab portion of the lid is connected to the cover while a handle provided on the cover serves to remove the cover from the container web and in turn the lid from its sealed relationship with the web. This is done by grasping the handle and applying one continuous pulling motion to release the cover from the container, thereby causing the lid to "peel" from the container web to expose the PBE device held therein. Such a canister apparatus allows easy and quick opening for fast donning of the PBE device.

Having the canister devices of the present invention under vacuum provides decompression protection, i.e., the canister may otherwise bulge and be damaged at low pressures encountered at high altitudes. The partially evacuated canister devices also protect the PBE device from carbon dioxide, humidity, and other gases/vapors, which can potentially degrade the efficiency of the PBE device, as is well known to those of ordinary skill in the art.

OBJECTS

It is therefore an object of the present invention to provide an improved storage container.

It is another object to provide a storage canister for a PBE device that prevents unwanted and inadvertent breaching of the canister while providing instant access to the contents held therein.

Another object is to provide a storage canister comprising a container apparatus for holding a PBE device and having a quick-opening "gasket seal" closure means that is opened by a continuous pulling force on a handle for the closure means to thereby access the PBE device held therein.

Yet another object is to provide a storage canister apparatus comprising a container for holding a PBE device and having a "peel top" closure means that is quickly opened by a continuous pulling force on a handle for the closure means to thereby access the PBE device held therein.

Still another object is to provide a partially evacuated storage canister apparatus that is capable of use in low pressured high altitude environments without breaching the canister.

Yet another object is to provide a storage canister apparatus for holding a PBE device that comprises an indicator for visual inspection of a status gauge that indicates whether the vacuum sealed integrity of the canister apparatus has been breached or not.

Finally, another object is to provide a storage canister apparatus comprising of a hard shell, fire-resistant container having a closure means that is vacuum sealed to the container and that is quickly and easily removed from the container to open the canister.

These and other objects become increasingly apparent to those of ordinary skill in the art by reference to the following description and to the drawings.

IN THE DRAWINGS

FIG. 1 is a perspective view of a "gasket seal" type storage canister apparatus 10 according to the present invention.

FIG. 2 is a broken away perspective view of the storage canister 10 shown in FIG. 1 with a handle 64 being moved into an extended position to begin opening the canister 10.

Figure 1:
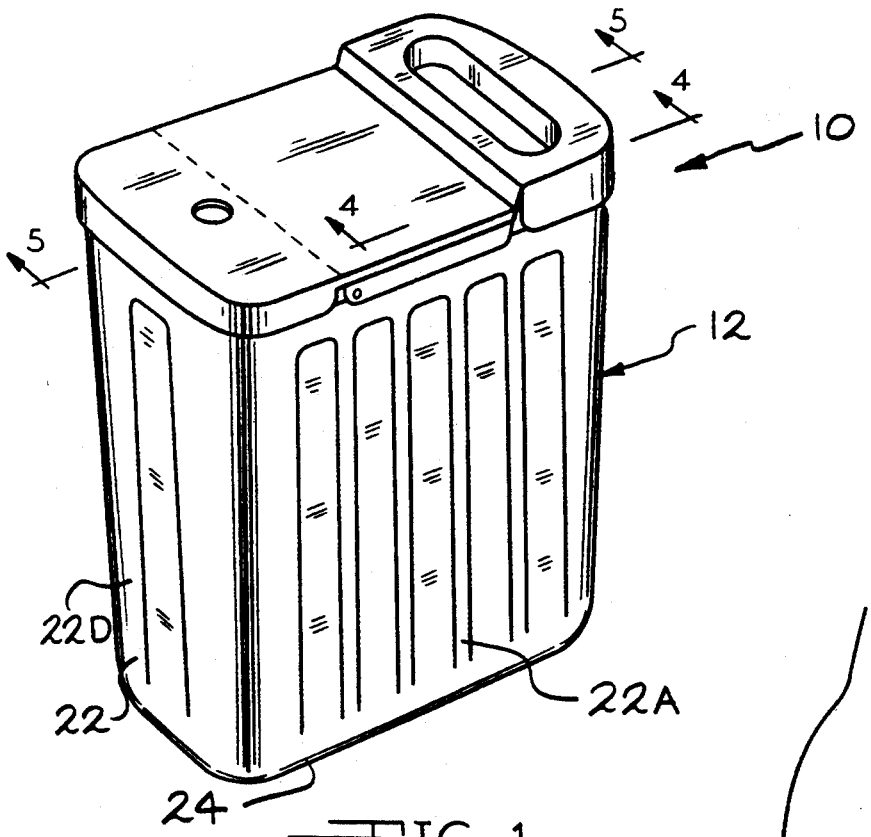
Figure 6:
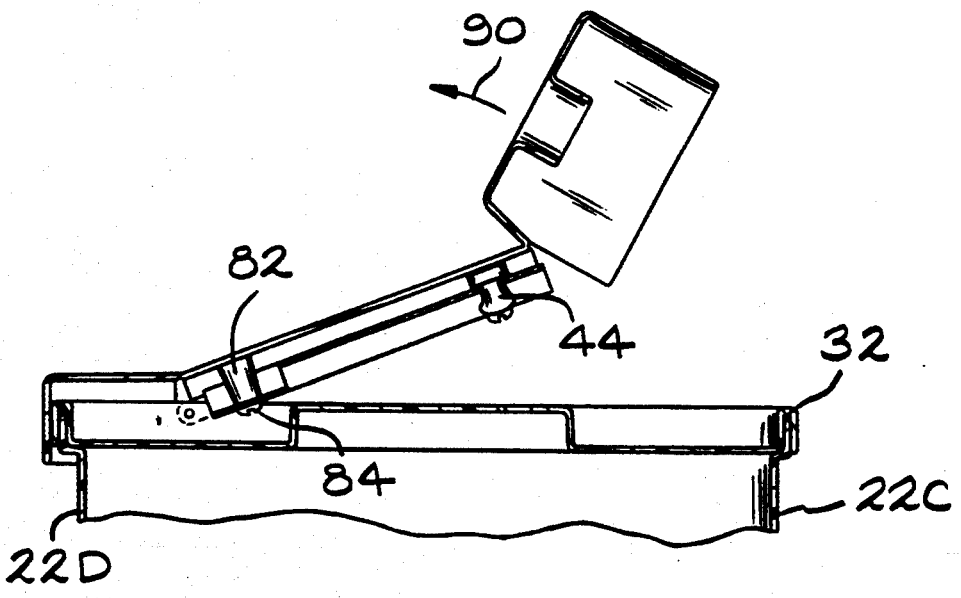

FIG. 6 is a partial cross-sectional view about along line 5—5 of FIG. 1 but with an outer cover 20 and clamping plate 18 moved into a fully extended position to remove vacuum release plug 44 from a vent opening 42 in an inner cover 16 supported on container 12.

Figure 7:
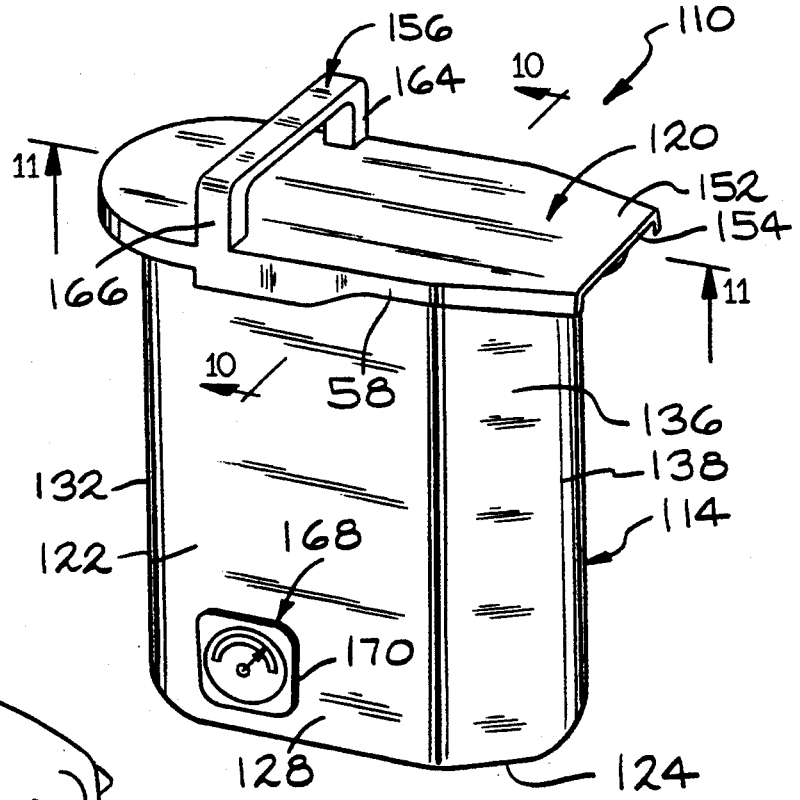

FIG. 7 is a perspective view of a "peel top" storage canister apparatus 110 according to the present invention.

Figure 8:
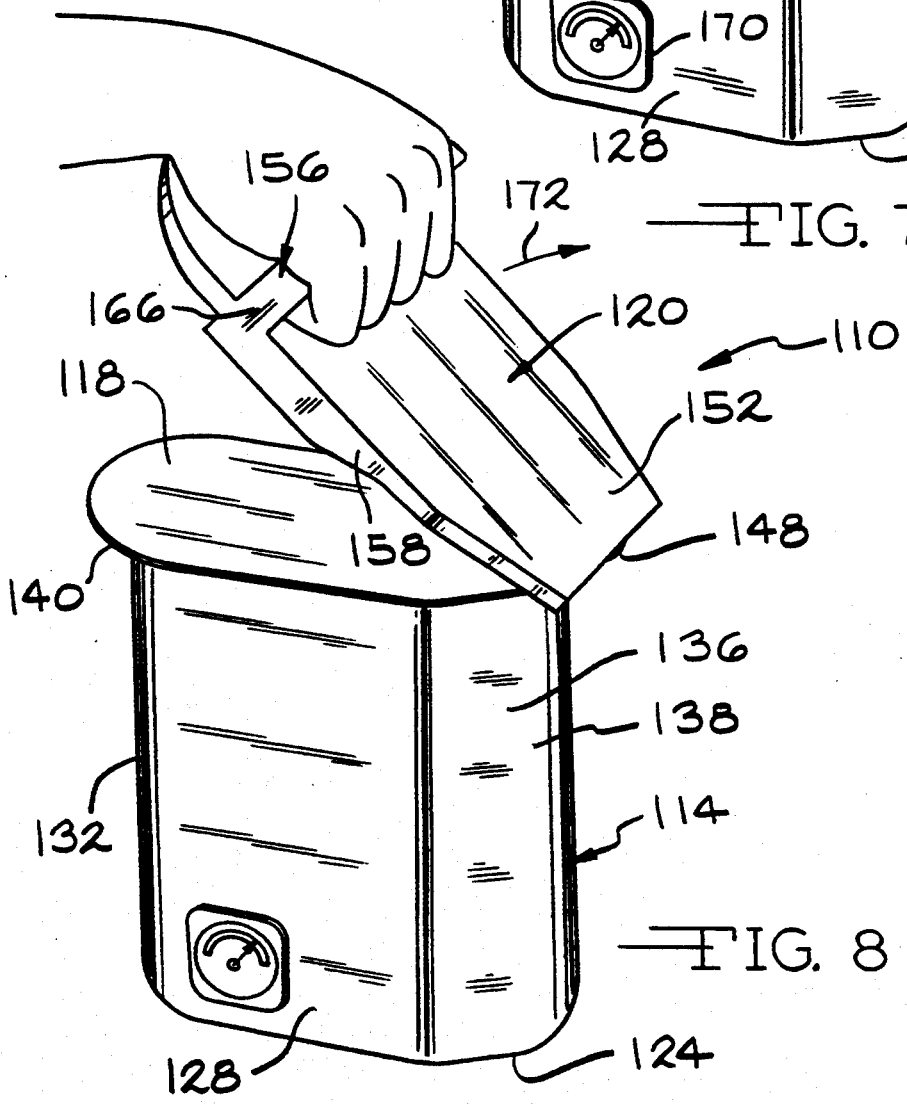

FIG. 8 is a perspective view of the storage canister 110 shown in FIG. 7 with a cover 120 being removed from a web 140 surrounding a container 114 to expose a lid 118 sealed to web 140.

Figures 9, 10, 11, 12:
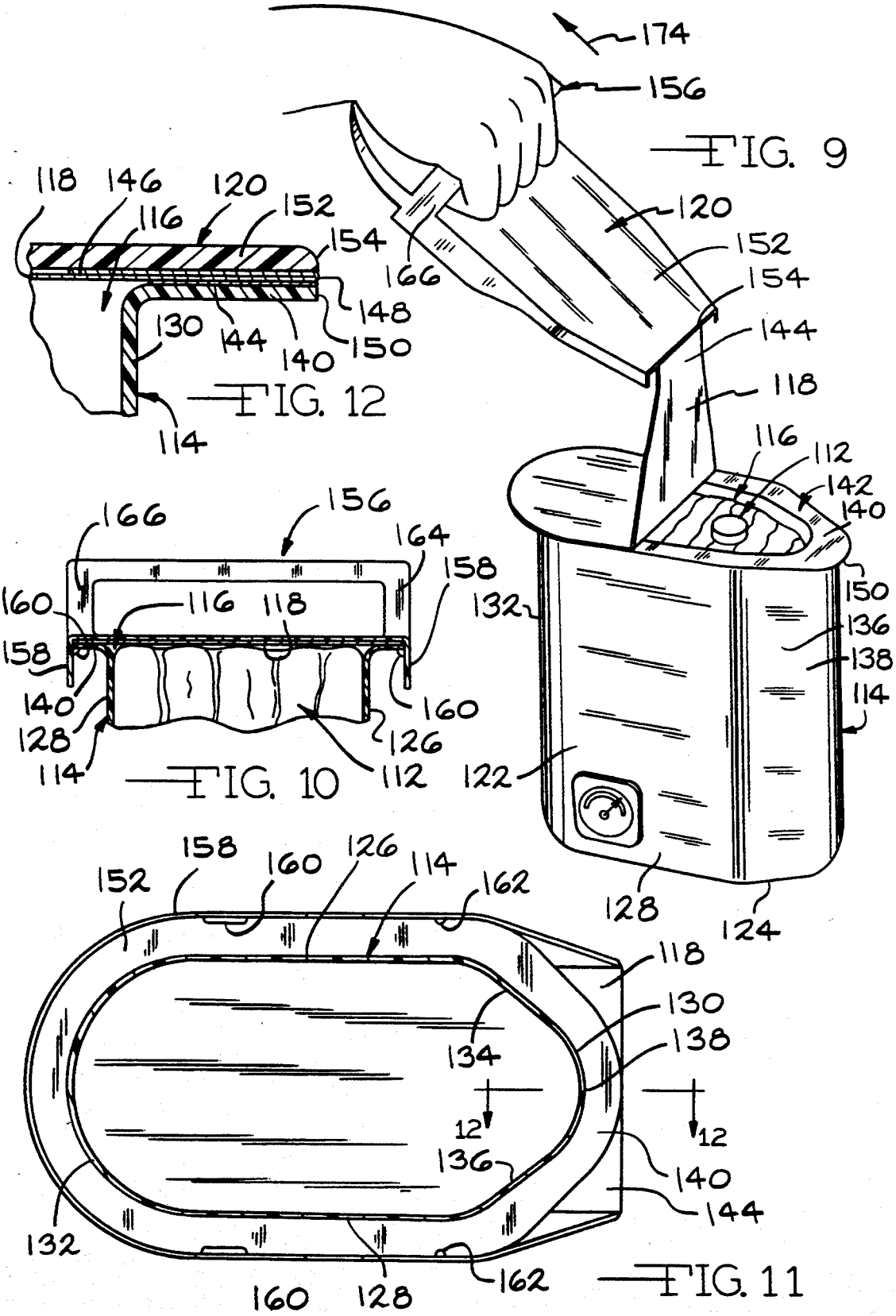

FIG. 9 is a perspective view of the storage canister 110 shown in FIG. 8 with cover 120 being pulled away from container 114 to "peel" the lid 118 from web 140.

FIG. 10 is an enlarged cross-sectional view about along line 10—10 of FIG. 7.

FIG. 11 is an enlarged cross-sectional view about along line 11—11 of FIG. 7.

FIG. 12 is an enlarged cross-sectional view about along line 12—12 of FIG. 11.

DETAILED DESCRIPTION

The terms "upper," "upwardly," "right," "left," "downwardly," and "outwardly" as used in this description simply refer to the orientation of FIGS. 1 to 12, and are not intended to be limiting.

Referring now to the drawings, FIGS. 1 to 6 show a "gasket seal" storage canister apparatus 10 for use with a protective breathing equipment (PBE) device (not shown in FIGS. 1 to 6) intended to be stored therein when not in use. As particularly shown in FIG. 3, canister 10 comprises a storage container 12 having an opening 14 leading into the interior of container 12, a closure means for the container 12 comprising an inner cover 16, a connected clamping plate 18 and an outer cover 20. PBE devices and their use are well known to those of ordinary skill in the art.

Figure 2:
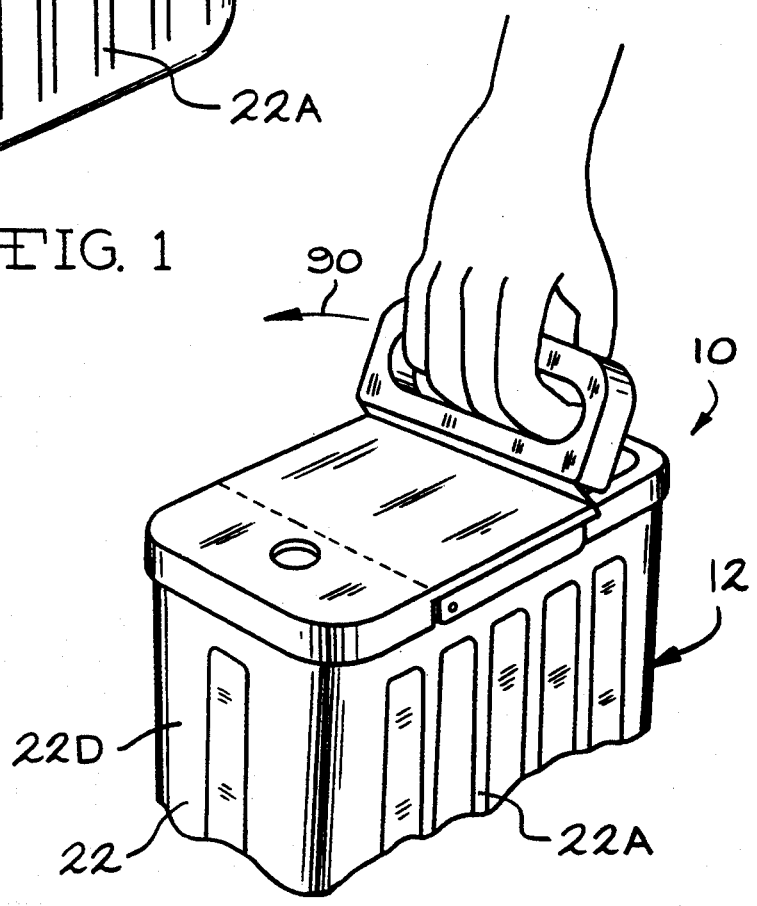
Figure 3:
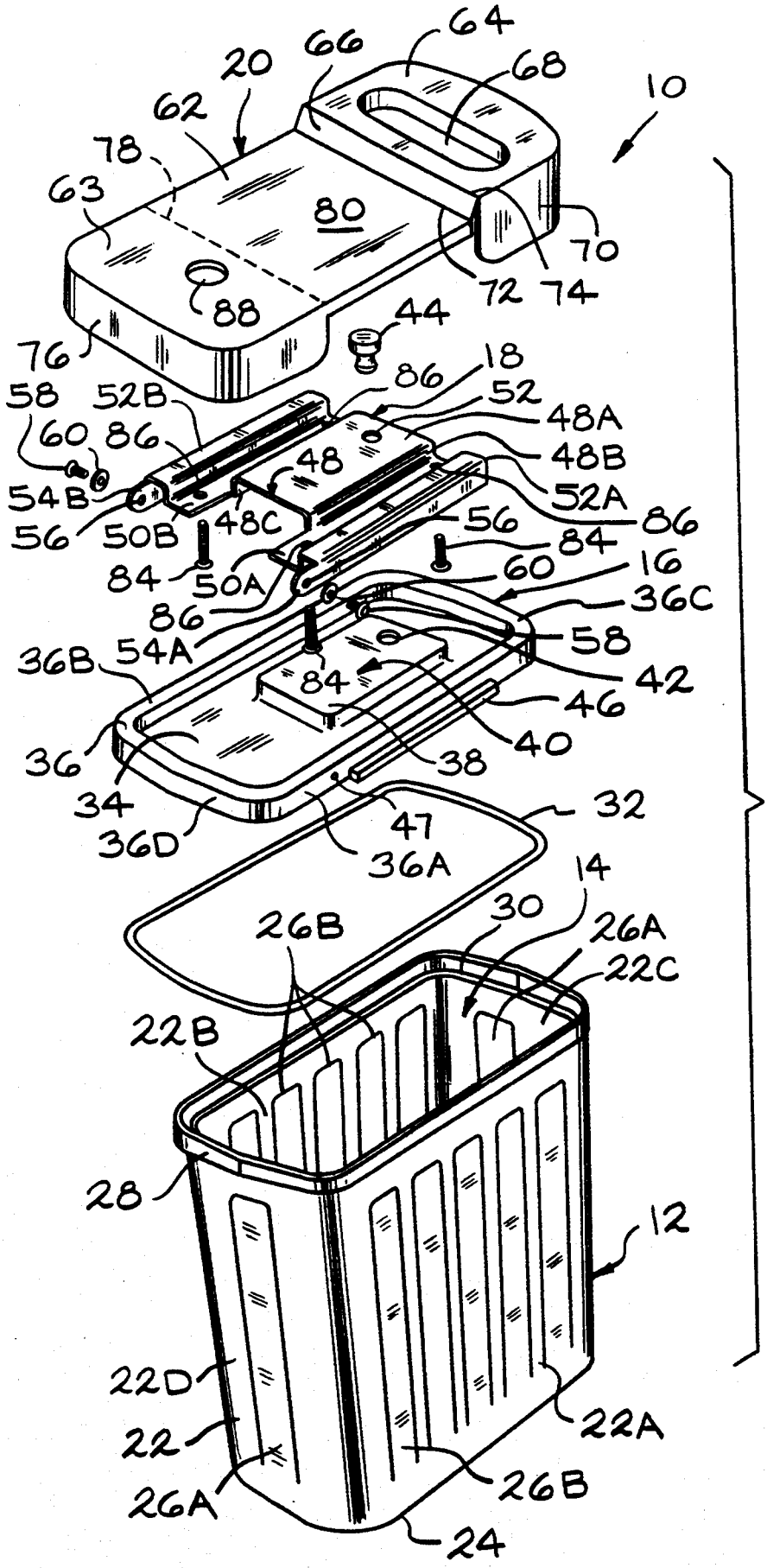
FIG. 3 is an exploded view of the storage canister 10 shown in FIG. 1.

As shown in FIGS. 1 to 3, container 12 is a rigid member that can be made of a metal or a plastic material, preferably an opaque plastic material formed by an injection molding process. Container 12 includes a surrounding side wall 22 extending upwardly from a peripheral edge of a planar bottom wall 24 to form the opening 14 providing access into the interior of container 12. Surrounding side wall 22 includes spaced apart lateral walls 22A and 22B extending to and joining with right and left end walls 22C and 22D. End walls 22C and 22D are each provided with an elongated, rectangularly shaped depression 26A while the lateral walls 22A and 22B are provided with a plurality of rectangularly shaped depressions 26B spaced at uniform intervals along the width thereof. The depressions 26A and 26B serve as strengthening means for the respective walls. The junction where bottom wall 24 meets lateral walls 22A and 22B, and right and left end walls 22C and 22D is rounded in a similar manner as the unions between the lateral walls 22A and 22B, and end walls 22C and 22D.

Surrounding side wall 22 and bottom wall 24 are plated or coated (not shown) on their inside surfaces by a material that enhances the vacuum barrier protection of container 12. This coating is preferably a chrome material or an electroless nickel platings but the coating may be any material that retards permeability through the walls 22 and 24. To further enhance the vacuum barrier properties of the container 12, the outside surfaces of side wall 22 and bottom wall 24 can also be plated in a manner similar to that of the inside surface. The outside surface of container 12 is then painted, with a color suitable for it intended use (i.e. safety yellow, neutral grays etc.).

Container 12 is completed by a surrounding and upwardly extending flange 28 that joins with the outer surface of lateral walls 22A and 22B and end walls 22C and 22D adjacent to the upper edges thereof to provide an inner surrounding ledge 30. The upper edge of flange 28 serves to support a sealing means, such as a gasket seal 32 that is preferably made of an elastomeric material. Gasket 32 helps to seal the inner cover 16 to flange 28 to close the opening 14 leading into container 12 and thereby contain the evacuated atmosphere inside canister 10 to protect the PBE device housed therein, as will be explained in detail presently.

As particularly shown in FIG. 3, inner cover 16 is a unitary member having a generally rectangular shaped plate portion 34 with a surrounding channel 36 joined to the peripheral edge thereof. Channel 36 has an inverted U-shaped cross-section formed of opposed lateral channel sections 36A and 36B joined to opposed end channel sections 36C and 36D. Channel 36 serves to removably seal inner cover 16 on container flange 28 by means of intermediate gasket 32 with flange 28 disposed between the opposed side walls comprising channel 36. Plate 34 is further provided with a raised portion 38 having a generally rectangular shape with an upper surface 40 parallel to plate 34. Raised portion 38 is spaced inwardly from channel 36 and is provided with a vent opening or aperture 42 that receives a vacuum release plug 44, preferably made of an elastomeric material and having an enlarged cylindrically shaped head with a depending, frustoconically shaped extension portion (FIG. 3). Plug 44 contains the evacuated environment inside container 12 with inner cover 16 removably sealed over container opening 14 by gasket 32. The vacuum is then released from container 12 by appropriate movement of the outer cover 20 and clamping plate 18, as will be explained in detail presently.

Inner cover 16 also has a pair of opposed rails 46 (only one rail 46 shown in FIG. 3) that connect to the outer periphery of channel 36 by a web (not shown)

extending therebetween. Rails 46 are provided adjacent to the lateral channel sections 36A and 36B but they only extend a portion of the length thereof. The webs joining the rails 46 to channel sections 36A and 36B help support the pivoting clamping plate 18. Inner cover 16 is completed by opposed openings or apertures 47 (only one opening 47 shown in FIG. 3) provided through the outer wall of the lateral channel sections 36A and 36B adjacent to the left end of rails 46 and proximate end channel section 36D.

Pivoting clamping plate 18 rests on the inner cover 16 and is made of a plastic or metal material, preferably metal, which is stamped to the shape shown in FIG. 3. Clamping plate 18 comprises a centrally located section 48 having an inverted U-shaped cross-section provided by a rectangular shaped plate 48A and opposed depending sides 48B and 48C. The lower surface of rectangular plate 48A contacts the upper surface 40 of inner cover plate 34 in an overlapping relationship. Rectangular plate 48A is provided with an opening 52 that in conjunction with vent opening 42 in inner cover 16 serve to mount the vacuum release plug 44 with the cylindrical head of plug 44 positioned on plate 48A and the frusto-conical portion of plug 44 extending through and received in openings 52 and 42.

Opposed horizontal webs 50A and 50B extend outwardly from the lower edge of the depending sides 48B and 48C of the central section 48 of clamping plate 18. The right edges of webs 50A and 50B are coplanar with the central section 48 while the left edges thereof extend beyond the plane of section 48. Webs 50A and 50B are in turn each provided with inverted U-shaped channels 52A and 52B joined to the outer edges thereof and having a right edge coplanar with the plane of central section 48 and coplanar with webs 50A and 50B. The left edge of channels 52A and 52B are coplanar with webs 50A and 50B except for opposed tabs 54A and 54B extending beyond the left plane thereof from the opposed outer walls of channels 52A and 52B, respectively. Tabs 54A and 54B are each provided with an opening or aperture 56 that receive a pivot means, such as a threaded screw 58 provided with an associated flat washer 60.

Figure 5:
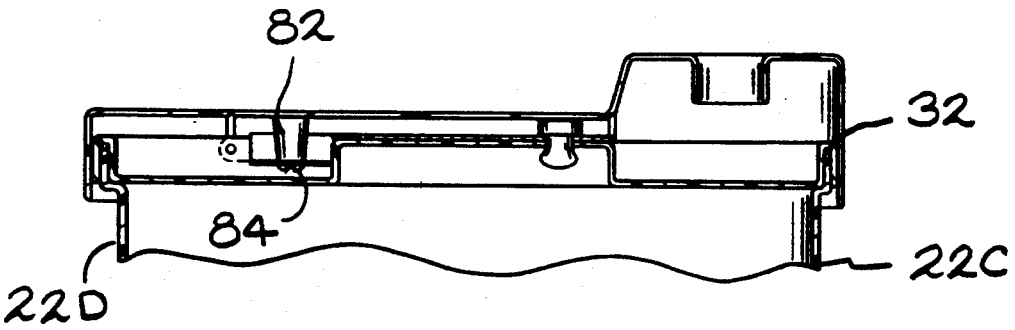
FIG. 5 is a partial cross-sectional view about along line 5—5 of FIG. 1.

As shown in FIGS. 5 and 6, when canister apparatus 10 is completely assembled, screws 58 extend through the openings 56 in the tabs 54A and 54B and the openings 47 in the lateral channel sections 36A and 36B of inner cover 16 to threadingly mate with threaded inserts (not shown) provided on the inside of the inner walls of channel sections 36A and 36B. That way, clamping plate 18 is able to pivot with respect to inner cover 16 about screws 58 to release the vacuum plug 44 supported in the opening 52 in clamping plate 18 from its sealed relationship in vent opening 42 in inner cover 16 to thereby release the vacuum held inside container 12 by cover 16 sealed to flange 28 by gasket 32, as will be explained in detail presently.

Storage canister 10 is further provided with the outer cover 20 which removedly mounts over the clamping plate 18 and inner cover 16. Outer cover 20 is preferably made of a plastic material and comprises a main outer cover section 62 and a handle 64 pivotably connected thereto by a first hinge 66. Handle 64 has a planar upper surface and is provided with a generally oval shaped opening 68 and a depending skirt 70 extending downwardly from the outer edge of handle 64. First hinge 66 provides for pivoting movement of handle 64 with respect to the main outer cover section 62 along a crease 72 adjacent to the main outer cover section 62 having a step 74 adjacent to handle 64. The crease 72 and step 74 are parallel with respect to each other.

As shown in FIGS. 1 to 3, the main section 62 of outer cover 20 has a planar upper surface that is spaced below and parallel to the plane of handle 64. With canister 10 completely assembled, the main outer cover section 62 overlays the lateral channel sections 36A and 36B of inner cover 16 beginning at the right end of the rails 46 and extending to the left to provide an overlapping relationship with the end channel section 36D of channel 36 of inner cover 16.

Outer cover 20 is completed by a shirt 76 which depends downwardly from the outer edge of a left portion 63 of the main outer cover section 62 from a position beginning along a plane formed by a second hinge 78 (shown in dashed lines in FIGS. 1 to 3) jointed between left portion 63 and a middle portion 80 of outer cover section 62. Second hinge 78 is parallel to the crease 72 of first hinge 66.

Figure 4:
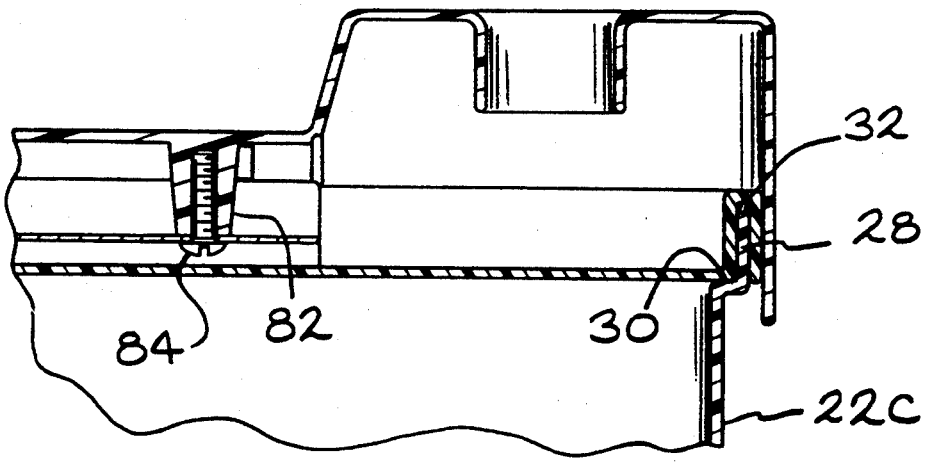
FIG. 4 is an enlarged view, partly in section, about along line 4—4 of FIG. 1.

As particularly shown in FIGS. 4 to 6, the under side of the middle portion 80 of the main outer cover section 62 provided between the first and second hinges 66 and 74 includes four (4) downwardly depending extensions 82 (FIGS. 4 to 6), positioned adjacent to the corners formed by the crease 72 of first hinge 66 and by the second hinge 78. Extensions 82 threadingly receive screws 84 provided through corresponding openings 86 in the opposed webs 50A and 50B of clamping plate 18 to secure the outer cover 20 thereto.

As shown in FIGS. 1, 2, 4 and 50 with canister 10 completely assembled, gasket 32 is supported along the upper edge of flange 28 surrounding the opening 14 leading into the interior of container 12. The inner cover 16 is then mounted on the container 12 with the flange 28 positioned between the side walls comprising channel 36 and with gasket 32 at an intermediate position disposed between flange 28 and channel 36 of inner cover 16. Clamping plate 16 is then pivotally attached to inner cover 16 with screws 58 extending through the openings 56 provided in tabs 54A and 54B of the inverted U-shaped channels 52A and 52B of cover 16 and received in openings 47 in the inner cover 16, adjacent to the left end of the rails 46. Threaded inserts (not shown) are molded into the inner surface of the outside wall of the inner cover channel 36 and theadingly receive screws 58 to maintain this pivotable relationship. The inside container 12 is then evacuated to provide a negative pressure held therein by the vacuum release plug 44 having its cylindrical portion resting on the upper surface of the rectangular plate 48A of the central section 48 of clamping plate 16 and the frusto-conically shaped extension portion positioned through the opening 52 in clamping plate 18 and received in the vent opening 42 in the raised section 38 of inner cover 16. This prevents the loss of the evacuated atmosphere present inside container 12 with inner cover 16 vacuum sealed to container 12 by gasket 32, as previously described in detail.

As shown in FIGS. 3 to 6, clamping plate 18 is in turn attached to outer cover 20 by screws 84 that extend through the openings 86 in the opposed webs 50A and 50B of clamping plate 18 and which are received in extensions 82 depending from the under side of the middle portion 80 of the outer cover 20. A status indicator port 88 is provided in the left portion 63 of the main cover section 62 and provides for visual inspection of a gauge means (not shown), which measures the interior pressure of container 12. The interior pressure relates to the humidity level present inside canister 10 which is an indication of the carbon dioxide level therein. Carbon dioxide is removed from the breathed air by the PBE device housed inside canister 10 and inadvertently breaching the vacuum seal and thereby admitting carbon dioxide into the canister 10 can prematurely degrade the effectiveness of the PBE device before it is ready to be used, as is well known to those of ordinary skill in the art. Another method is to provide the gauge means as a humidity indicator of the type commercially available from Humidial Corp., Colton, Calif., sold as part no. 2156-20.

In use, the closure means for container 12 is able to be quickly and easily removed to expose the PBE device held therein. This is done by grasping handle 64 with the user's fingers positioned through the oval shaped opening 68, as shown in FIGS. 2 and 6, and with the user holding container 12 in the other hand (not shown). A pulling force is then applied to handle 64 in a direction shown by arrow 90 in FIG. 2. This causes handle 64 to pivot about the first hinge 66 and with respect to the main cover section 62 of outer cover 20 to move handle 64 into an extended position. Further pulling force applied to handle 64 in the direction of arrow 90 causes the middle portion 80 of the main cover section 62 to pivot about the second hinge 78 and with respect to left portion 63 of the main cover section 62 to move the middle portion 80 into a fully extended, spaced relationship with respect to the inner cover 16. As middle portion 80 pivots, the clamping plate 18 secured to the middle portion 80 by screws 84 received in extensions 82 is caused to move away from inner cover 16, pivoting about the axis provided by screws 58 extending through the openings 56 in the extending tabs 54A and 54B and received in the openings 47 in inner cover 16. The pivoting movement of middle portion 80 and clamping plate 18 creates a moment about the axis of screws 58 which is sufficient to overcome the force of the vacuum inside container 12 acting on the vacuum release plug 44. Then, as clamping plate 18 moves away from inner cover 16 the frusto-conical portion of the vacuum release plug 44 is pulled from the vent opening 42 in the raised portion 38 of the inner cover 16 to release the vacuum and break the seal between inner cover 16 and container 12. With the vacuum removed, further pulling force on handle 64 causes the inner cover 16 to easily separately and be removed from the gasket 32 and flange 28 of container 12 to expose the PBE device housed therein. The PBE device is now able to be removed from container 12 and donned for its intended purpose, as is well know to those of ordinary skill in the art.

FIGS. 7 to 12 show another embodiment of a storage canister apparatus 110 intended to house a protective breathing equipment (PBE) device 112 (FIGS. 9 and 10) stored therein when not in use. Canister 110 is of the "peel top" type and comprises a storage container 114 having an opening 116 leading into the interior of container 114, a closure means for the container 114 comprising a flexible lid 118 serving as an inner cover and a rigid outer cover means 120 that is removable snap fitted to the container 114, over lid 118.

Container 114 is a rigid member that can be made of a metal or a plastic material, preferably an opaque plastic material formed by an injection molding process. Container 114 includes a surrounding side wall 122 extending upwardly from a peripheral edge of a planar bottom wall 124 to form the opening 116 leading into the interior of container 114. As clearly shown in FIG. 11, surrounding side wall 122 includes spaced apart lateral walls 126 and 128 extending to and joining with right and left end walls 130 and 132. Left end wall 132 has a semi-circular shape in cross- section while right end wall 130 is formed by a first angled wall section 134 joined to lateral wall 126, a second angled wall section 136 joined to lateral wall 128 with a connecting end wall 138 having a parabolic cross-section extending to and meeting with the angled wall sections 134 and 136. The junction where bottom wall 124 meets lateral walls 126 and 128, and right and left end walls 130 and 132 is rounded.

Surrounding side wall 122 and bottom wall 124 are plated or coated (not shown) on their inside surfaces by a material that enhances the vacuum barrier protection of container 114. This coating is preferably a chrome material or an electroless nickel plating, but the coating may be any material that retards permeability through the walls 122 and 124. To further enhance the vacuum barrier properties of the container 114, the outside surfaces of side wall 122 and bottom wall 124 can also be plated in a manner similar to that of the inside surface. The outside surface of container 114 is then painted, with color suitable for the intended purpose of container 12, i.e., safety yellow, neutral gray, etc.

Container 114 is completed by a surrounding web 140 that extends in a plane extending outwardly from the upper edge of surrounding side wall 122 and away from container opening 116, preferably parallel with the bottom wall 124. Web 140 is covered by lid 118 which has a sufficient area to lay over the entire upper surface 142 of web 140 with an outer edge of lid 118 being coplanar with the outer edge of web 140 to thereby serve as an inner cover means for opening 116. Lid 118 is preferably made of a flexible laminate material and has a thin cross-section that is releasable sealed to web surface 142. Preferably, lid 118 comprises a sheet of aluminum material having a polyester laminate on the bottom surface that is heat sealed to web 142. In that respect, lid 118 comprises the closure means for the opening 116 into container 114. Lid 118 also is provided with a lid tab portion 144 (FIGS. 9, 11 and 12) that extends outwardly beyond web 140 in the vicinity of right end wall 130 of container 114. As shown in FIG. 12, lid tab 144 has an extension portion 146 folded in an overlapping relationship with tab 144 along a crease 148. Crease 148 is aligned along the outermost edge 150 of web 140 in the vicinity of parabolic end wall 138 (FIGS. 11 and 12).

As shown in the drawings, canister 110 is completed by outer cover 120 which is a rigid member made of a metal or a plastic material. Cover 120 comprises the closure means and is preferably an injection molded plastic member mounted on container 114 over lid 118 thereby covering lid 118 which closes the opening 116 into container 114. Cover 120 comprises an upper plate 152 that is sized to mount over the entire annular extent of web 140 and is parallel with web 140 when so mounted. A right edge 154 of cover plate 152 is aligned along the crease 148 of lid 118 and along the outermost edge 150 of web 140 in the vicinity of the parabolic end wall 138. The extension portion 146 of lid 118 is joined to the under side of cover plate 152 from the right edge 154 of plate 152 to a position inwardly of the right end wall 130 of container 114 (FIG. 12) to connect outer cover 120 to lid 118 and provide a means for removing lid 118 from container 114 by applying a pulling force to a handle 156 mounted on cover plate 150, as will be explained in detail presently.

A depending flange or skirt 158 extends downwardly from the outer periphery of cover plate 150 and is positioned outwardly beyond the outer edge of web 140. As shown in FIGS. 7 to 9, skirt 158 has a uniform downwardly extending depth except for that portion of skirt 158 adjacent to handle 156. There skirt 58 has an increased depth that extends to a position at about a midpoint along the length of the spaced apart lateral walls 126 and 128 where skirt 158 inclines upwardly and towards the right to once again form the uniform depth extending to the right edge 154 of cover plate 150 before it terminates adjacent to the opposed ends of the crease 148 formed by the overlapping relationship between extension portion 146 and tab 144 of lid 118.

As shown in FIG. 11, skirt 158 has two opposed sets of right and left detents 160 and 162 that serve to snuggling mate cover 120 on web 140. Left detents 160 extend inwardly towards each other from skirt 158 and are spaced from the under side of cover plate 152 a sufficient distance to accommodate the thickness of web 140 in an intermediate position between cover plate 152 and detents 160. This provides a snap fitting relationship between cover 120 and that section of web 140 located in the vicinity of the junction of semi-circular cross-sectional left end wall 132 and spaced apart lateral walls 126 and 128. In a similar manners right detents 162 extend inwardly towards each other from skirt 158 spaced from the under side of cover plate 152 a sufficient distance to accommodate web 140 in an intermediate position between cover plate 152 and detents 162. This provides a snap fitting relationship between cover 120 and that section of web 140 located a short distance towards detents 158 from where the first and second angled wall sections 134 and 136 of right end wall 130 meet respective spaced apart lateral walls 126 and 128. Detents 160 are somewhat elongated whereas detents 162 have a substantially square shape extending from skirt 156. Detents 160 and 162 thus serve to hold cover 120 in place, over lid 118 and the open end 116 of container 114.

As shown in FIGS. 7 and 10, cover 120 is provided with handle 156 as an integral member having a general elongated U-shape with its opposed ends 164 and 166 connecting to cover plate 152 in the vicinity of where the opposed lateral walls 126 and 128 of container 114 join with the left end wall 132 and directly above the opposed elongated detents 160.

As shown in FIGS. 7 to 10, canister 110 is further provided with a gauge means 168 that is mounted on the inside of lateral wall 128 adjacent bottom wall 124. This is done by masking the inside and outside surfaces of lateral wall 128 during the plating and painting steps, as previously discussed, to provide a sight window 170. Gauge 168 is then mounted on the inside surface of lateral wall 128 in window 170. Gauge means 168 is shown as a vacuum gauge that measures the interior pressure of canister 110 with lid 118 vacuum sealed on web 140 of container 114. The interior pressure relates to the humidity level inside canister 110 which is an indication of the carbon dioxide level therein. Carbon dioxide is removed from the breathed air by the PBE device and inadvertently breaching the vacuum seal and thus admitting carbon dioxide into the canister 110 can prematurely degrade the effectiveness of the PBE device before it is ready to be used, as is well known to those of ordinary skill in the art. Another method is to provide gauge means 168 as a humidity indicator, as previously discussed with respect to canister 10.

In use, cover 120 is removed from container 114 by grasping handle 156 in one hand (FIG. 8) while holding container 114 in the other hand (not shown) or other suitable holding means, such as a mounting bracket (not shown). A pulling force is then applied to handle 156 in a direction shown by arrow 172 in FIG. 8. This causes cover 120 to move away from container 114 when the opposed elongated detents 160 release from their snap fitting relationship with web 140. Once this occurs that portion of cover 120 adjacent to left end wall 132 of container 114 is free to move away from web 140. Since cover 120 is a rigid member, pulling force 172 further releases square detents 162 from their snap fitting relationship with web 140 to completely release cover 120 from web 140. This causes extension portion 146 of lid 118, which is bonded to the under side of cover plate 152, to move away from its overlapping relationship with lid tab 144 while the remainder of lid 118 remains sealed around the peripheral extent of web 140. The direction of the pulling movement on handle 156 is now changed to about a 45° angle with respect to the plane of web 40, as shown by arrow 174 in FIG. 9. This causes lid 118 to begin to "peel" away from web 140 in the vicinity of that portion of web 140 adjacent to right end wall 138 of container 114. Once lid 118 begins to peel from web 140, the vacuum seal between lid 118 and web 140 is released. Continued pulling movement 174 on handle 156 of cover 120 causes lid 118 to peel from web 140 a sufficient amount to expose the PBE device 112 housed inside container 114. The PBE device 112 is now able to be removed from container 114 and donned for its intended purpose, as is well known to those of ordinary skill in the art.

It is therefore apparent that the present invention accomplishes its objects. Therefore, it is intended that the foregoing description be only representative of the present invention and that the present invention be limited only by the hereinafter appended claims.

What is claimed is:

1. A canister apparatus, which comprises:

(a) container means having an open end leading therein;

(b) closure means provided to close the open end of the container means, wherein the closure means comprises an outer cover means that overlays an inner cover means mounted on the container means and sealed to the open end thereof;

(c) joining means connecting between the outer cover means and the inner cover means;

(d) handle means provided on the closure means; and (e) seal means supported on the outer cover means and extending to the inner cover means and in communication with the interior of the container means, the seal means being positioned intermediate the handle means and a first pivot means for the outer cover means and wherein the handle means is moveable to first position, spaced from the container means and in such a manner so as to cause the outer cover means to pivot about the first pivot means to remove the seal means from contact with the inner cover means and breach its sealed relationship with respect to the open end of the container means and wherein the handle means is further movable to a second position spaced from the container means greater than that for the first position and in such a manner so as to cause the outer cover means to actuate the joining means to remove the inner cover means from its mounted relationship with respect to the container means to thereby provide for separating the closure means from the container means for accessing therein.

2. The canister apparatus of claim 1 wherein the seal means comprises a plug means supported by the outer cover means and sealed in an inner cover opening in communication with the interior of the container means.

3. The canister apparatus of claim 1 wherein the open end of the container means is provided with a surrounding flange means supporting a gasket means that helps provide the sealed relationship between the container means and the inner cover means.

4. The canister apparatus of claim 1 wherein the inner cover means is sealed to the open end of the container means in a vacuum sealed relationship.

5. The canister apparatus of claim 4 further comprising a gauge means mounted inside the container means and serving to indicate the vacuum sealed relationship between the inner cover means and the container means.

6. The canister apparatus of claim 4 further comprising a gauge means mounted inside the container means provided with the closure means and wherein either the container means or the closure means is provided with a viewing means that provides for visual inspection of the gauge means serving to indicate the vacuum sealed relationship between the inner cover means and the container means.

7. The canister apparatus of claim 1 wherein the handle means is initially positioned proximate the container means and is movable to an extended position, spaced from the container means less than that for the first position with the outer cover means remaining in its overlaying relationship and with the inner cover means remaining in its sealed relationship with respect to the open end of the container means.

8. The canister apparatus of claim 7 wherein the handle means is connected to the outer cover means by a second pivot means that provides for pivotable movement of the handle means to the extended position.

9. A canister apparatus, which comprises:

(a) container means having an open end leading therein, wherein the open end is provided with a web means;

(b) closure means provided to close the open end of the container means, wherein the closure means comprises a rigid outer cover means that overlays an inner cover means sealed to the open end of the container means and wherein the outer cover means has a flange means provided with a plurality of detent means that engage the peripheral extent of the web means to removably mount the outer cover means on the container means;

(c) joining means connecting between the outer cover means and the inner cover means; and (d) handle means provided on the closure means and initially positioned proximate the container means, wherein the handle means is first movable to an intermediate position spaced from the container means with the detent means on the flange means released from the web means to remove the rigid outer cover means from its overlaying relationship and with the inner cover means remaining in its sealed relationship with respect to the container means, and wherein the handle means is further movable to a fully extended position, spaced from the container means greater than that for the intermediate position and in such a manner so as to cause the outer cover means to actuate the joining means to release the inner cover means from its sealed relationship with respect to the open end of the container means to thereby provide for separating the closure means from the container means for accessing therein.

10. The canister apparatus of claim 9 wherein the inner cover means is made of a flexible material that is sealed to the open end of the container means.

11. The canister apparatus of claim 9 wherein the open end of the container means comprises a surrounding web means having a sealing surface and wherein the inner cover means is made of a flexible material that is sealed to the sealing surface of the web means.

12. canister apparatus of claim 11 wherein the inner cover means comprises a sheet of aluminum material having a polymeric laminate sealed to the sealing surface of the web means.

13. canister apparatus of claim 12 wherein the sealing surface of the web means is planar and the polymeric laminate comprising the inner cover means is a polyester material.

14. A method for accessing an interior of a canister apparatus, which comprises:

(a) providing the canister apparatus comprising: a container means having an open end leading therein; closure means provided to close the open end of the container means, wherein the closure means comprises an outer cover means that overlays an inner cover means mounted on the container means and sealed to the open end thereof; joining means connecting between the outer cover means and the inner cover means; handle means provided on the closure means; and seal means supported on the outer cover means and extending to the inner cover means, the seal means positioned intermediate the handle means and a first pivot means for the outer cover means;

(b) moving the handle means to a first position, spaced from the container means and causing the outer cover means to pivot about the first pivot means and removing the seal means from contact with the inner cover means and thereby breaching its sealed relationship with respect to the open end of the container means; and (c) further moving the handle means to a second position, spaced from the container means greater than that for the first position and causing the outer cover means to actuate the joining means to remove the inner cover means from its mounted relationship with respect to the container means thereby separating the closure means from the container means for accessing therein.

15. The method of claim 14 including initially positioning the handle means proximate the container means and then moving the handle means to an extended position, spaced from the container means less than that for the first position with the outer cover means remaining in its overlaying relationship and with the inner cover means remaining in its sealed relationship with respect to the open end of the container means.

16. The method of claim 15 including connecting the handle means to the outer cover means by a second pivot means and pivoting the handle means to the extended position by manipulating the handle means about the first pivot means.

17. The method of claim 14 including providing the seal means comprising a plug means supported by the outer cover means and sealed in an inner cover opening in communication with the interior of the container means and moving the handle means into the first position and causing the outer cover means to pivot about the first pivot means and actuating relative movement with respect to the inner cover means thereby releasing the plug means from the opening in the inner plate means to release the sealed relationship between the inner cover means and the container means.

18. The method of claim 14 including providing the open end of the container means with a surrounding flange means supporting a gasket means helping provide the sealed relationship between the container means and the inner cover means.

19. A method for accessing an interior of a canister apparatus, which comprises:

a) providing the canister apparatus comprising: container means having an open end leading therein, wherein providing the open end with a web means; closure means closing the open end of the container means, wherein the closure means comprises a rigid outer cover means that overlays an inner cover means sealed to the open end of the container means and wherein providing the outer cover means including a flange means having with a plurality of detent means engaging the peripheral extent of the web means to removably mount the outer cover means on the container means; joining means connecting between the outer cover means and the inner cover means; and handle means provided on the closure means and initially positioned proximate the container means;

b) moving the handle means to an intermediate position, spaced from the container means with the detent means releasing from the web means and the rigid outer cover means removing from its overlaying relationship with respect to the inner cover means and with the inner cover means remaining in its sealed relationship with respect to the container means; and c) further moving the handle means to a fully extended position, spaced from the container means greater than that for the intermediate position and causing the outer cover means to actuate the joining means to release the inner cover means from its sealed relationship with respect to the open end of the container means thereby separating the closure means from the container means for accessing therein.

20. The method of claim 19 including providing the inner cover means of a flexible material that is sealed to the open end of the container means.

* * * * *